US005724633A

United States Patent [19]

Amemiya

[11] Patent Number: 5,724,633

[45] Date of Patent: Mar. 3, 1998

[54] IMAGE FORMING APPARATUS IN WHICH DIFFERENT COLOR TONERS HAVE SUBSTANTIALLY EQUAL CHARGE AMOUNTS

[75] Inventor: Koji Amemiya, Tokyo, Japan

[73] Assignee: Canon Kabushiki Kaisha, Tokyo, Japan

[21] Appl. No.: 684,929

[22] Filed: Jul. 19, 1996

[30] Foreign Application Priority Data

Jul. 20, 1995 [JP] Japan ..... 7-207516

[51] Int. Cl.[6] ..... G03G 15/01

[52] U.S. Cl. ..... 399/223; 399/299; 399/303

[58] Field of Search ..... 399/298, 299, 399/300, 303, 231, 302, 223, 225, 285

[56] References Cited

U.S. PATENT DOCUMENTS 5,172,172 12/1992 Amemiya et al. ..... 399/303
5,189,478 2/1993 Hara et al. ..... 399/302 X
5,253,018 10/1993 Takeuchi et al. ..... 399/49
5,363,178 11/1994 Matsumoto ..... 399/299
5,525,752 6/1996 Izumizaki et al. ..... 399/275
5,552,872 9/1996 Amemiya et al. ..... 399/308

*Primary Examiner*—S. Lee
*Attorney, Agent, or Firm*—Fitzpatrick, Cella, Harper & Scinto

[57] ABSTRACT

An image forming apparatus includes a plurality of photosensitive members, charging devices provided respectively with the photosensitive members to charge the photosensitive members, an exposing device for exposing the charged photosensitive members to image light, developing devices for developing electrostatic images on the photosensitive members with toners of different colors, a transfer device for sequentially conveying a toner image carrying medium to the transfer-positions of the photosensitive members and transferring the toner images of different colors to overlap each other on the toner image carrying medium, and a color mixing device for mixing the colors of the stacked toner images. The charge amounts of the toners for developing the electrostatic images on the photosensitive members are substantially equal.

7 Claims, 7 Drawing Sheets

IMAGE FORMING APPARATUS IN WHICH DIFFERENT COLOR TONERS HAVE SUBSTANTIALLY EQUAL CHARGE AMOUNTS

BACKGROUND OF THE INVENTION

1. Field of the Invention

The present invention relates to an image forming apparatus such as an electrophotographic copying machine or printer and, more particularly, to an image forming apparatus for forming a multi-color image by using a plurality of photosensitive members.

2. Related Background Art

Multi-color image forming apparatuses represented by a full-color image forming apparatus have the problem that the image formation rate is low, i.e., the number of copies printed per unit time is small.

To solve this problem, a full-color image forming apparatus has been proposed in which the image formation rate is increased by providing a plurality of photosensitive members in a one-to-one correspondence with different color toners to be overlapped each other, without forming toner images of different colors repeatedly on the same photosensitive member.

When different color toner images are to be formed on a plurality of photosensitive members as described above, if the image reproduction density of each station is independently controlled, a multi-gradation (e.g., 256-level) reproduction density can be obtained for monochromatic images of magenta, cyan, yellow, and black, respectively.

Unfortunately, a discontinuity occurs in the gradation reproduction of a color formed by mixing a plurality of color toners (e.g., blue as a mixture of magenta toner and cyan toner).

SUMMARY OF THE INVENTION

It is an object of the present invention to provide an image forming apparatus in which a discontinuity in the gradation reproduction of a color as a mixture of a plurality of color toners is made small.

It is another object of the present invention to provide an image forming apparatus in which developing devices have substantially equal development characteristics.

It is still another object of the present invention to provide an image forming apparatus being provided with a plurality of photosensitive members, charging means provided respectively with the photosensitive members for charging the photosensitive members, exposing means for exposing the charged photosensitive members to image light, developing means for developing electrostatic images on the photosensitive members with toners of different colors, transfer means for sequentially conveying a toner image carrying medium to transfer positions of each photosensitive member and transferring and overlapping the toner images of different colors on the toner image carrying medium, and color mixing means for mixing the colors of the laminated toner images, wherein charge amounts of the toners for developing the electrostatic images on the photosensitive members are substantially equal.

Other objects of the present invention will become apparent from the following detailed description taken in conjunction with the accompanying drawings.

DETAILED DESCRIPTION OF THE PREFERRED EMBODIMENT

An embodiment of the present invention will be described below with reference to the accompanying drawings.

Figure 1:
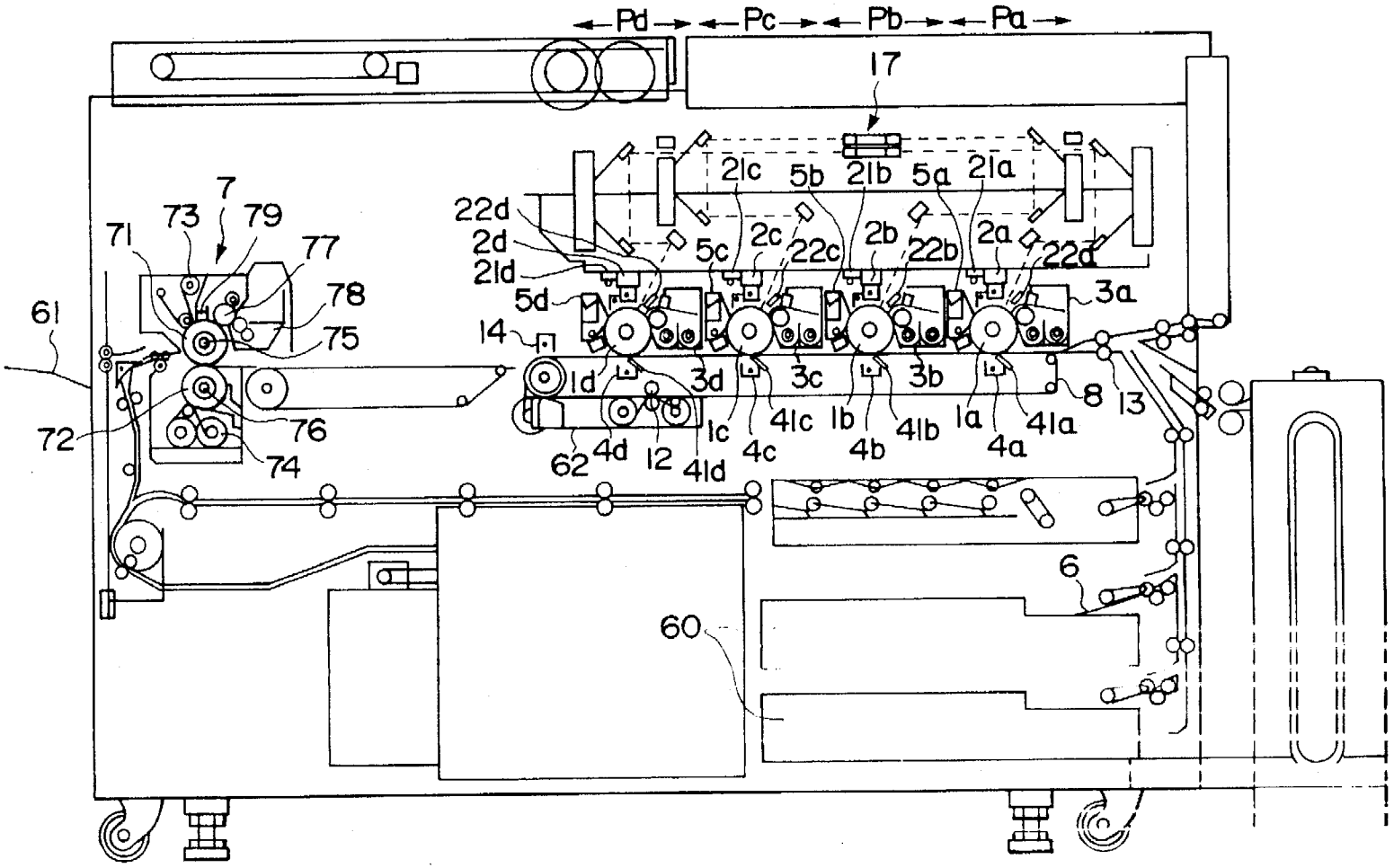
FIG. 1 is a schematic view showing the construction of one embodiment of an image forming apparatus of the present invention.

FIG. 1 is a sectional view of a full-color digital copying machine as an image forming apparatus according to the embodiment of the present invention.

In this embodiment, first, second, third, and fourth image formation portions Pa, Pb, Pc, and Pd are provided in the main member of a color electrophotographic recording apparatus. These image formation portions have the same construction and form visual images (toner images) of different colors.

More specifically, the image formation portions Pa, Pb, Pc, and Pd have their respective dedicated image carriers, i.e., in this embodiment electrophotographic photosensitive drums 1*a*, 1*b*, 1*c*, and 1*d*, respectively. Images formed on these electrophotographic photosensitive drums 1*a*, 1*b*, 1*c*, and 1*d* in the image formation portions Pa, Pb, Pc, and Pd are sequentially transferred to be overlapped each other on a recording medium 6 which is carried and conveyed by a recording medium carrier 8 which moves adjacently to these image formation portions. The images on the recording medium 6 are heated and pressed by a fixing unit 7 and their colors are mixed and fixed. The resulting full-color recorded image is delivered to a tray 61.

Latent image formation sections in these image formation portions will be described below. Around the curved surfaces of the photosensitive drums 1*a*, 1*b*, 1*c*, and 1*d*, charge-removal exposure lamps 21*a*, 21*b*, 21*c*, and 21*d*, drum chargers 2*a*, 2*b*, 2*c*, and 2*d*, a laser beam exposure device 17 as an image exposing means, and potential sensors 22*a*, 22*b*, 22*c*, and 22*d* are arranged. The photosensitive drums 1*a*, 1*b*, 1*c*, and 1*d* charge-removed by the charge-removal exposure lamps 21*a*, 21*b*, 21*c*, and 21*d* are uniformly charged by the drum chargers 2*a*, 2*b*, 2*c*, and 2*d* and subsequently exposed by the laser beam exposure device 17. Consequently, color-separated electrostatic latent images corresponding to an image signal are formed on the photosensitive drums 1*a*, 1*b*, 1*c*, and 1*d*. The image forming means usable in the image forming apparatus of the present invention is not limited to the laser beam exposure device 17 described above. That is, a well-known, so-called multi-value exposing means, such as an LED array exposure device, capable of irradiating light having a plurality of light quantity levels, except OFF (zero) level, in a basic image unit (pixel) can be suitably adopted.

The electrostatic latent images on the photosensitive drums are developed into visual images by developing means. That is, the developing means include developing devices 3*a*, 3*b*, 3*c*, and 3*d* filled with predetermined amounts of color developers, e.g., two-component developers each consisting of toner and carrier, of cyan, magenta, yellow, and black. These developing means develop the electrostatic latent images formed on the photosensitive drums 1*a*, 1*b*, 1*c*, and 1*d* into visual images (toner images).

A transfer unit will be described below. The recording medium 6 as a toner image carrying medium, which is stored in a recording medium cassette 60 and on which toner images are transferred and laminated, is supplied to the recording medium carrier 8 via registration rollers 13.

The recording medium carrier 8 is a dielectric resin film sheet such as a polyethyleneterephthalate resin film sheet (PET sheet), a polyfluorovinylidene resin film sheet, or a polyurethane resin film sheet. The two end portions of any of these sheets are set to overlap each other and joined to form an endless belt, or a seamless belt having no seam is used. When a belt having a seam is used, it is preferable to use a sensing means for sensing seam position (not shown) so that no transfer is performed on the seam.

When this recording medium carrier 8 starts rotating, the recording medium 6 is conveyed from the registration rollers 13 onto the recording medium carrier 8. An image write signal is turned on and an image is formed on the first photosensitive drum 1*a* at a certain timing.

A transfer charger 4*a* and a transfer pressing member 41*a* are provided below the first photosensitive drum 1*a*. The transfer pressing member 41*a* applies a uniform pressing force to the photosensitive drum, and the transfer charger 4*a* applies an electric field to the drum. Consequently, the toner image on the photosensitive drum 1*a* is transferred onto the recording medium 6. That is, the recording medium 6 is held on the recording medium carrier 8 by an electrostatic attracting force and conveyed to the second image formation portion Pb, and the image is transferred onto the recording medium 6. The recording medium 6 onto which toner images are similarly transferred in the third and the fourth image formation portions Pc and Pd is charge-removed by a separation charger 14, separated from the recording medium carrier 8 due to attenuation of the electrostatic attracting force, and conveyed to the fixing unit 7.

The fixing unit 7 for mixing and fixing the laminated color toner images consists of a fixing roller 71, a pressing roller 72, heat-resistant cleaning members 73 and 74 for cleaning the rollers 71 and 72, respectively, heaters 75 and 76 for heating the rollers 71 and 72, respectively, an oil coating roller 77 for coating the fixing roller 71 with a releasant oil such as dimethylsilicone oil, an oil reservoir 78 for supplying the oil, and a thermistor 79 for controlling the fixing temperature.

After the transfer, the developers remaining on the photosensitive drums 1*a*, 1*b*, 1*c*, and 1*d* are removed by photosensitive drum cleaning units 5*a*, 5*b*, 5*c*, and 5*d*, respectively, to prepare for the next latent image formation to be subsequently performed. The developers remaining on the recording medium carrier 8 are charge-removed by a belt charge-remover 12 to remove the electrostatic attracting force. In this embodiment, the resultant developers are removed by a cleaning device 62 including nonwoven fabric. As the cleaning device 62, it is also possible to use a rotary fur brush, a blade, or a device using the both.

The developing means used in the image forming apparatus of this embodiment will be described in more detail below with reference to FIG. 2. Since the developing means in the image formation portions Pa, Pb, Pc, and Pd have the same construction, only the developing means in the image formation portion Pa will be described.

Figure 2:
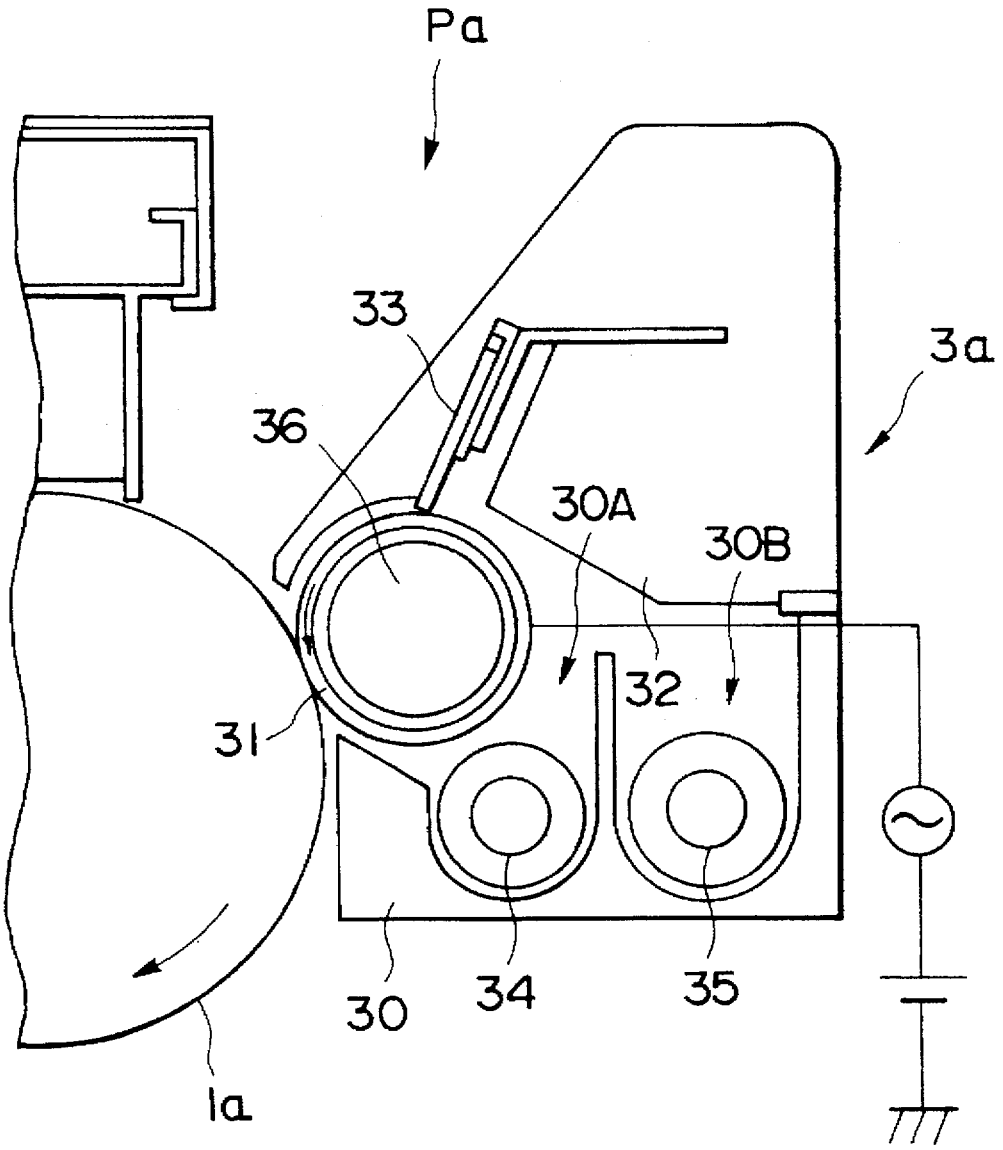
FIG. 2 is a sectional view of one embodiment of a developing means in the image forming apparatus in FIG. 1.

FIG. 2 is a substantially sectional view of the developing means in the image formation portion Pa. The developing device 3*a* arranged to oppose the photosensitive drum 1*a* comprises a developer container 30 which contains a two-component developer, a developing sleeve 31 as a developer carrier, a developer returning member 32 (a member for regulating the amount of a developer on the developing sleeve 31), and a blade 33. The developer returning member 32 regulates the developer conveyed from a developer supply position to a brush cutting position by the developing sleeve 31. The blade 33 is a member for regulating the brush height (layer thickness) of a developer. The developing device 3*a* further includes an optical developer density sensor (not shown) as a developer density sensing means for sensing the developer density (toner density) of a two-component developer.

The interior of the developer container 30 is partitioned into a developing chamber 30A and an agitating chamber 30B by a partition 37 which extends substantially vertically. The developing chamber 30A and the agitating chamber 30B contain a two-component developer consisting of nonmagnetic toner and magnetic carrier. The portion above the partition 37 is open, and any excess two-component developer in the developing chamber 30A is collected into the agitating chamber 30B. First and second screw-type developer agitating conveyor means 34 and 35 are arranged in the developing chamber 30A and the agitating chamber 30B, respectively. The first agitating conveyor means 34 agitates and conveys the developer in the developing chamber 30A. The second agitating conveyor means 35 agitates and conveys, under the control of a developer density control unit, toner supplied from a toner replenishment tank (not shown) to the upstream side of this second agitating conveyor means 35 and the developer already existing in the agitating chamber 30B, thereby making the toner density uniform. Developer-passages (not shown) are formed in the end portions on the front and the back sides of the partition 37 to allow the developing chamber 30A and the agitating chamber 30B to communicate with each other. By the conveying forces of the agitating conveyor means, the developer in the developing chamber 30A whose toner density is lowered because the toner is consumed in development is moved into the agitating chamber 30B through one passage.

An opening is formed in a position, corresponding to the development zone facing the photosensitive drum 1*a*, of the developing chamber 30A of the developing device. The developing sleeve 31 is rotatably arranged to be partially exposed to this opening. The developing sleeve 31 is made from a nonmagnetic material and rotates in a direction indicated by the arrow in FIG. 2 during development. A magnet 36 as a magnetic field generating means is fixed in the developing sleeve 31.

A two-component developer supplied to the surface of the developing sleeve 31 by the agitating conveyor means is held in the state of a magnetic brush on the surface of the developing sleeve 31 by the magnetic force of the magnet 36. The two-component developer in this state is conveyed to the development zone opposing the photosensitive drum 1*a* by the rotation of the developing sleeve 31. On the way of the conveyance, the magnetic brush on the developing sleeve 31 is cut by the developer returning member 32 and the blade 33. As a consequence, the amount of the developer conveyed to the development zone is kept at a proper amount.

The developer thus conveyed to the development zone by the developing sleeve 31 is supplied to the photosensitive drum 1*a* and develops an electrostatic latent image formed on there. To increase the development efficiency, i.e., the supply efficiency of toner to the latent image, a power supply applies to the developing sleeve 3 a superposed developing bias of a DC voltage and an AC voltage or one of DC and AC developing bias voltages. By the action of the superposed electric field of the DC and the AC electric fields or by the action of one of the DC and the AC electric fields, the toner of the two-component developer is moved to the electrostatic latent image on the photosensitive drum 1*a* and the electrostatic latent image is visualized as a toner image.

The nonmagnetic toner used in this embodiment consists of toner particles with an average particle size of 5 to 11 μm, formed by dispersing 80 to 90 wt % of a polyester resin, 5 to 20 wt % of a coloring pigment, and a metal complex of alkyl-substituted salicylic acid as a negative charge controlling agent. The toner is externally added with 0.2 to 2 wt % of titanium oxide ($TiO_2$). Silica also can be used as the external additive. As the magnetic carrier, arbitrary ferrite carrier particles, particularly sintered ferrite particles are used. That is, any of Zn ferrite, Ni ferrite, Cu ferrite, Mn—Mg ferrite, Cu—Zn ferrite, and Ni—Zn ferrite is used as a core material, and particles of this core material are coated with 0.5 to 2 wt % of an acrylic resin in order to improve the triboelectrification property, the environmental stability, and the durability, thereby forming carrier particles with an average particle size of 30 to 60 μm. As the coating agent it is also possible to properly, selectively use, e.g., a polyester resin, a fluorine resin, and a silicone resin.

Figure 3:
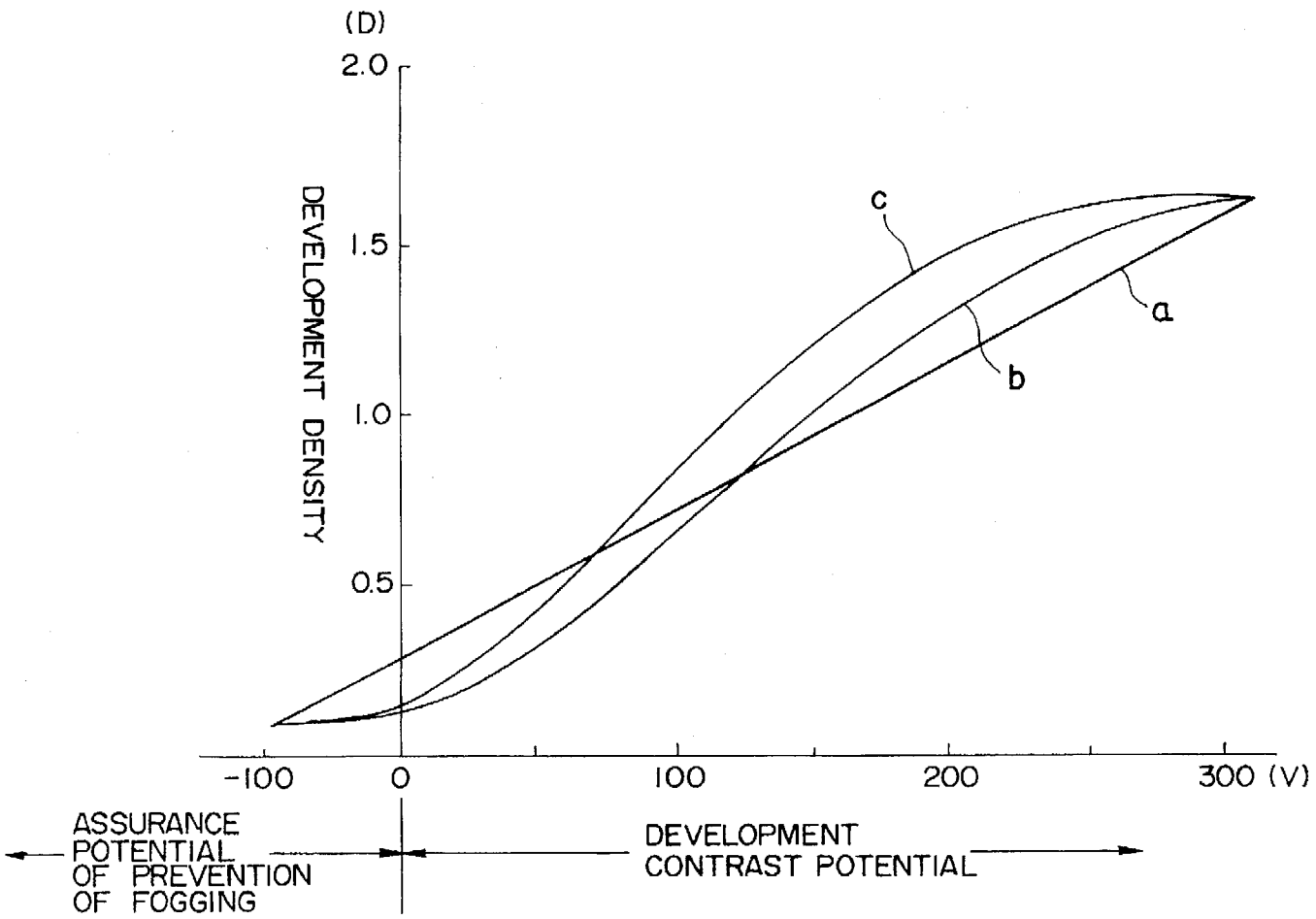
FIG. 3 is a graph showing the development characteristics of developers different in the average triboelectricity.

Yellow, magenta, cyan, and black toners were prepared as the toners and mixed with the magnetic carrier to prepare two-component developers. These two-component developers were filled in the developing devices, and a developing bias was applied to the developing sleeves to perform development. FIG. 3 is a V-D graph in the case of such development, showing relationships between the development contrast potential (assurance potential for prevention of fogging) (V), as one development characteristic, which is the potential difference between the photosensitive member and the developing sleeve, and the image development or reproduction density (D). The development characteristic of the magenta developer with respect to an ideal development characteristic a is indicated by a curve b. Also, the development characteristic of another magenta developer is indicated by a curve c.

The present invention is directed to the development characteristics of toners of different colors. To simplify the explanation, however, a description will be made by using developers of the same magenta color having different development characteristics.

The developer conditions by which the development characteristic b was obtained, are as follows.

18.5 wt % of a magenta pigment (C.I. Pigment Red 6) and 0.5 wt % of a negative charge controlling agent were mixed in 90 wt % of a polyester resin as a base, and 1.0 wt % of titanium oxide was externally added to the mixture. As carriers, two types of sintered ferrite particles coated with 0.5 wt % and 2.5 wt % of an acrylic resin were prepared.

The developers thus prepared were filled in the developing devices and image formation was performed under the following conditions. The moving velocity (Vp) of the surface of the photosensitive drum is set at 135 mm/sec, and reversal development in which toner is deposited on a portion exposed to have a low potential, is performed. The photosensitive drum potentials are dark potential Vd=−500 (V) as a potential in a region not irradiated with light and light potential Vl=−100 (V) as a potential in a region irradiated with light. The DC component of the developing bias is Vdc=−400 (V). In the reversal development, the development contrast is defined as follows:

(development contrast)=(light potential)−(developing bias DC)

The fogging potential shown in FIG. 3 is defined as follows:

(fogging potential)=(dark potential)−(developing bias DC)

In this embodiment, the development contrast is 300 (V).

Figure 4:
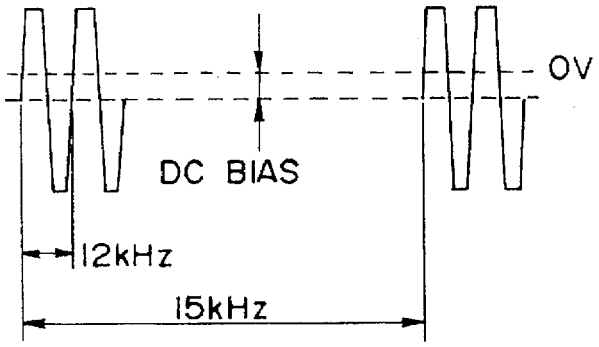
FIG. 4 is a view showing a development bias.

A waveform as shown in FIG. 4 is used as the developing bias. The AC component of the bias is Vpp=2 (kV), the frequency of the AC component is 12 (kHz), and the repetitive frequency of the two waves was 1.5 (kHz).

The conditions of the developing device are that the peripheral speed of the developing sleeve was 1.7 times the peripheral speed of the photosensitive drum and, as illustrated in FIG. 2, the developing sleeve is rotated in the same direction as the photosensitive drum in the development zone. Also, the developer returning member 32 and the blade 33 are so adjusted that the amount of the developer in the development zone was 40 mg/cm$^2$.

As described above, two types of sintered ferrite particles coated with 0.5 wt % and 2.5 wt % of an acrylic resin are prepared as carriers. The development characteristic (development contrast-to-image density) b is obtained when the coating amount of the acrylic resin was 2.5 wt %. The development characteristic c is obtained when the acrylic resin coating amount is 0.5 wt %.

The present inventors have made extensive studies on this difference between the development characteristics and found that there is a large difference between average charge amounts (to be referred to as "average triboelectricities" hereinafter) of toners in the development zone. The average triboelectricity of the toner showing the development characteristic b was 30 μC/g, and that of the toner showing the development characteristic c was 20 μC/g.

This average triboelectricity was measured by a blow mesh method. The blow mesh method will be described below.

Figure 5:
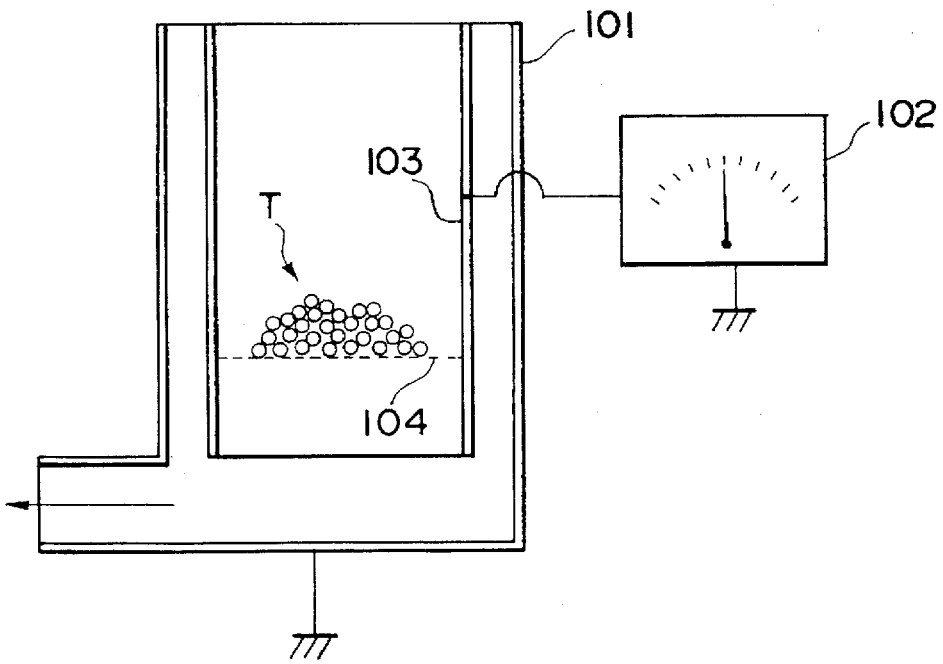
FIG. 5 is a view for explaining an average triboelectricity measuring device.

A vessel with the shape shown in FIG. 5 consists of a grounded outer vessel 101 and an inner vessel 103 which is connected to an electrometer 102 and insulated from the outer vessel 101. A mesh 104 so selected as to prevent the passage of particles having a diameter equivalent to that of carrier particles and to allow the passage of particles having a diameter equivalent to that of toner particles is arranged inside the inner vessel 103. A developer is charged in the inner vessel 103. The inner vessel 103 is also connected to a suction device. To obtain the average triboelectricity, a two-component developer whose weight is previously measured, is placed in the inner vessel 103, and the charge amount is measured by the electrometer. The measured charge amount and weight are c1 and m1, respectively. Subsequently, only toner particles are drawn by the suction device, and the charge amount is measured by the electrometer. The measured charge amount is c2. Thereafter, the weight of the remaining carrier is measured as m2, and the average triboelectricity is calculated by the following equation:

$$(\text{average triboelectricity})=(c1-c2)/(m1-m2)$$

Although the present inventors have implied that a development characteristic close to the curve a in FIG. 3 is preferable, this does not mean that the characteristic b is impractical. The way this determination is properly made, will be described below. Prior to the explanation, an image signal processing circuit for obtaining a gradation image suited to this embodiment will be described.

Figure 6:
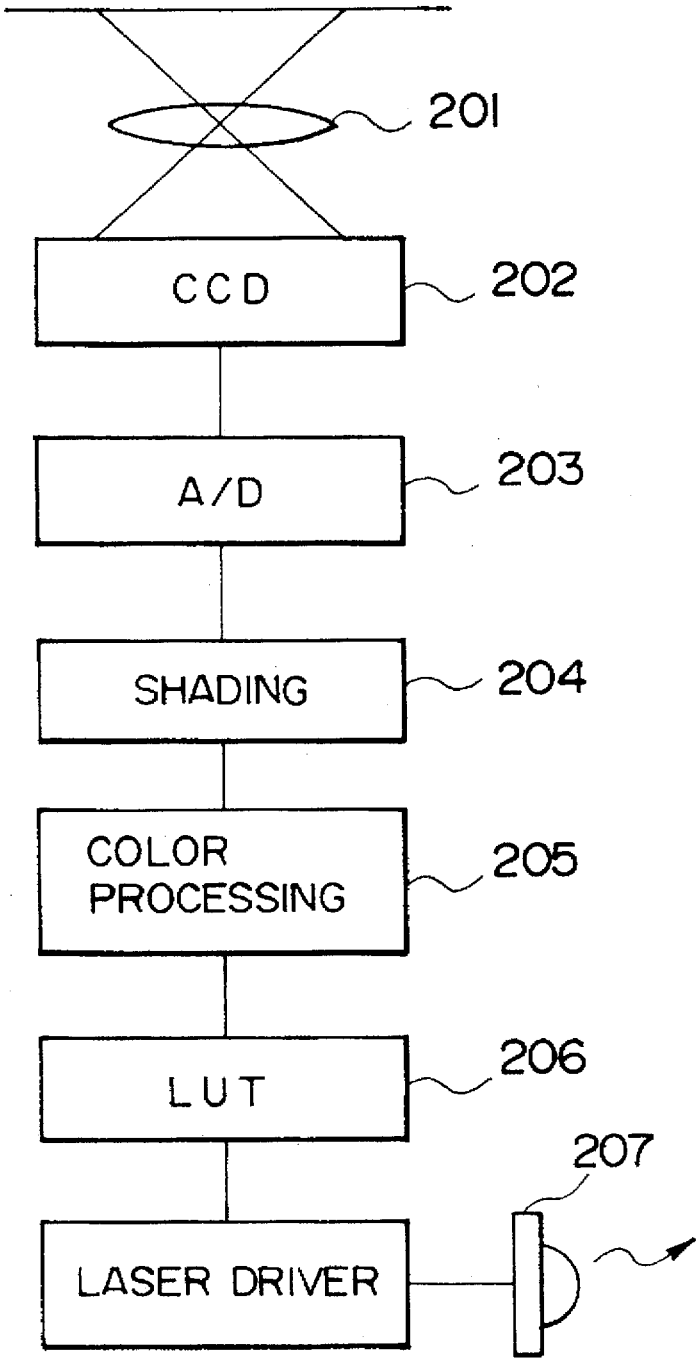
FIG. 6 is a block diagram showing processing for an image signal from a CCD.

Referring to FIG. 6, a coupling lens 201 irradiates the optical image of an original onto a CCD 202, and the CCD 202 converts the image into a luminance signal. An A/D converter 203 converts the luminance signal into a digital luminance signal. A generally used A/D-converted digital signal is an 8-bit (256-level) signal, and so the luminance signal of the read original is converted into a 256-level digital signal.

A shading circuit 204 corrects a sensitivity variation of the CCD 202 in the obtained luminance signal. The luminance is converted into a density by using the fact that the density is proportional to the LOG (luminance signal). That is, the corrected luminance signal is converted into a density signal by a LOG converter. The density signal is then color-processed by a masking UCR (processing for making background white or the like) circuit (to be referred to as an "image processing circuit" hereinafter) 205. Thereafter, the exposure device 17 for the image carriers exposes the photosensitive drums 1*a*, 1*b*, 1*c*, and 1*d*.

The exposure device 17 uses, e.g., a semiconductor laser, as the exposing means and includes a circuit which can decompose and expose the 8-bit (256-level) image density signal as a light quantity or as an ON time. As described above, the exposure device 17 is not limited to the one used in this embodiment. That is, it is possible to use any optional multi-value exposing means capable of irradiating light having a plurality of light quantity levels, except the OFF level, in a basic image unit (pixel).

A lookup table (to be referred to as an "LUT" hereinafter) 206 used in this embodiment will be described below. The LUT 206 performs density adjustment so that the density corresponding to the image density signal is faithfully reproduced on the image carrier. The LUT is formed by using the development characteristic b obtained previously. The function of the LUT will be described below.

Figure 7A:
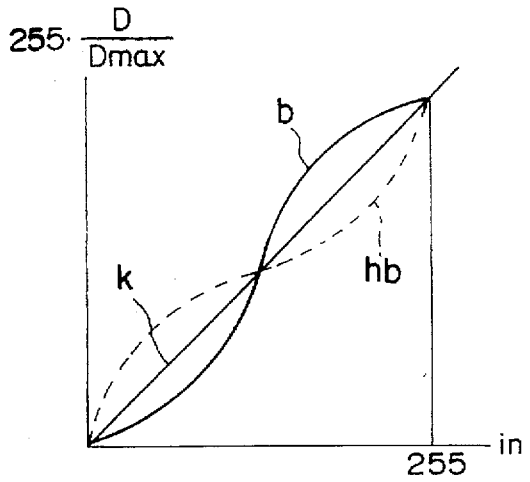
FIGS. 7A and 7B are graphs showing one example of sensitometry to explain the operation principle of image formation performed by the image forming apparatus of the present invention by using an LUT.
Figure 7B:
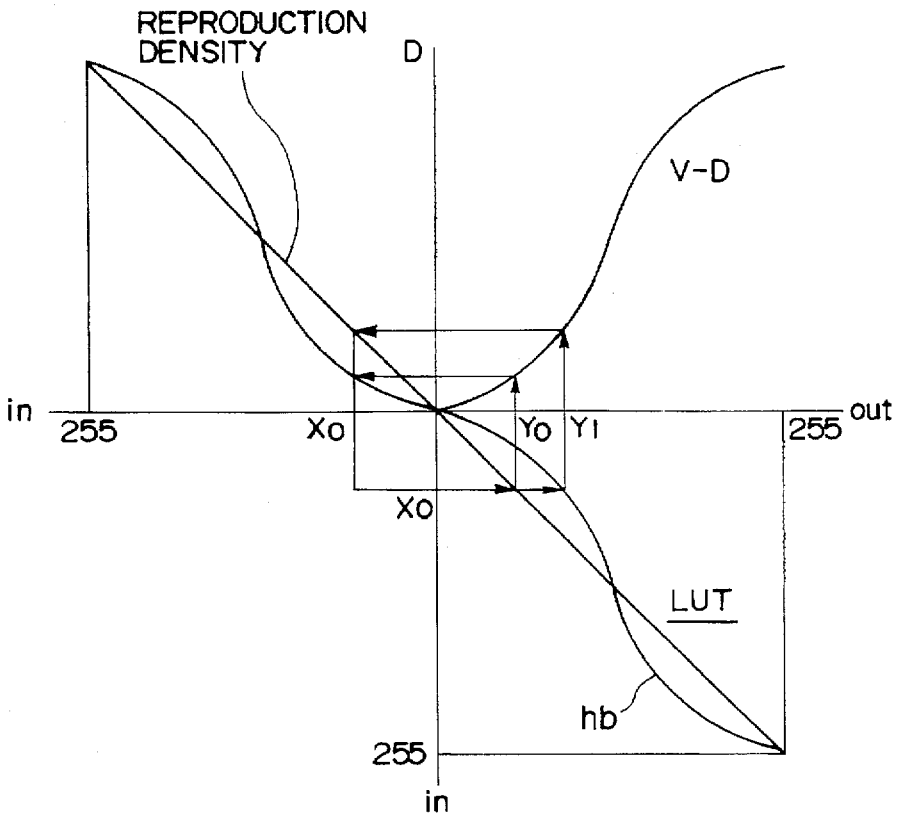

The LUT 206 constitutes a light amount selecting means capable of selecting a predetermined one of previously prepared light amount levels. The LUT 206 has a function of converting a level X (one of 0 to 256) of the density signal from the image processing circuit 205 into another level Y. Assume, for example, that the LUT is set such that the same level as an input signal is to be output. If this is the case, the development characteristic b shown in FIG. 3 is rewritten as "input signal-to-image density" as illustrated in FIGS. 7A and 7B and hence becomes a reproduction image density input signal (proportional to the density). That is, an input signal $X_0$ produces an output signal $Y_0$ and this indicates that this LUT is unnecessary if the development characteristic is a.

Accordingly, to obtain the characteristic of a reproduced image, when the development characteristic is b, similar to that when the development characteristic is a, normalization is performed as shown in FIG. 7A by using 256 levels assuming that the maximum value of the density plotted on the ordinate is originally decomposed into 8 bits (256 levels). A characteristic hb is prepared by moving, symmetrically to a straight line k in FIG. 7A, the relationship between the input level and the normalized output image level. This characteristic hb is input to the LUT as illustrated in the fourth quadrant in FIG. 7B (sensitometry), and an input signal is converted into an output signal for development in accordance with the characteristic hb. Referring to FIG. 7B, it will be understood that the input signal $X_0$ becomes an output signal $Y_1$, i.e., the density of a reproduced image in the second quadrant in FIG. 7B is based on the development characteristic a.

The density of a signal from the image processing circuit seems to be faithfully reproduced when this LUT is used, but that is not the case in practice. This will be described below by forming an LUT by using the development characteristic c in the same fashion as when the development characteristic b is used.

The maximum density of development is adjusted by the development contrast. Therefore, the development contrast is set to 250 (V) as can be seen from FIG. 3. As is apparent from the sensitometry in FIG. 8B, an image signal proportional to the density from the image processing circuit is faithfully reproduced.

When, however, toner of another color, e.g., cyan, having the development characteristic c is prepared and image formation is actually performed by developing the toner by using the image forming apparatus suitable to the present invention, a gradation reproducibility discontinuity occurs in blue which is a mixed color of magenta and cyan. This is due to loss of signals in the LUT.

A reason for this will be described below.

When the development characteristic does not have a linear shape such as a, the LUT is curved into an S shape. In the I/O characteristic obtained by using this LUT, non-integral values such as 3.3 and 5.7 are output with respect to input 0 to 256 levels.

If digital processing is performed for this I/O characteristic, both of levels 3 and 4 are corrected into 3 by the LUT, and level 100 does not exist after the correction.

This is the loss of signals in the LUT.

When LUTs of magenta and cyan have the same shape, a gradation reproduction characteristic identical with that for each single color can be obtained for blue which is a mixed color of magenta and cyan. If the shapes of these LUTs are largely different, however, a very large number of signals are lost from blue, and this results in a color discontinuity.

Figure 8A:
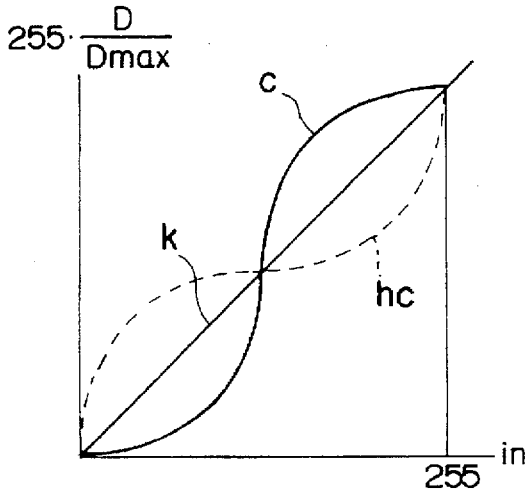
FIGS. 8A and 8B are graphs showing another example of sensitometry to explain the operation principle of image formation performed by the image forming apparatus of the present invention by using an LUT.
Figure 8B:
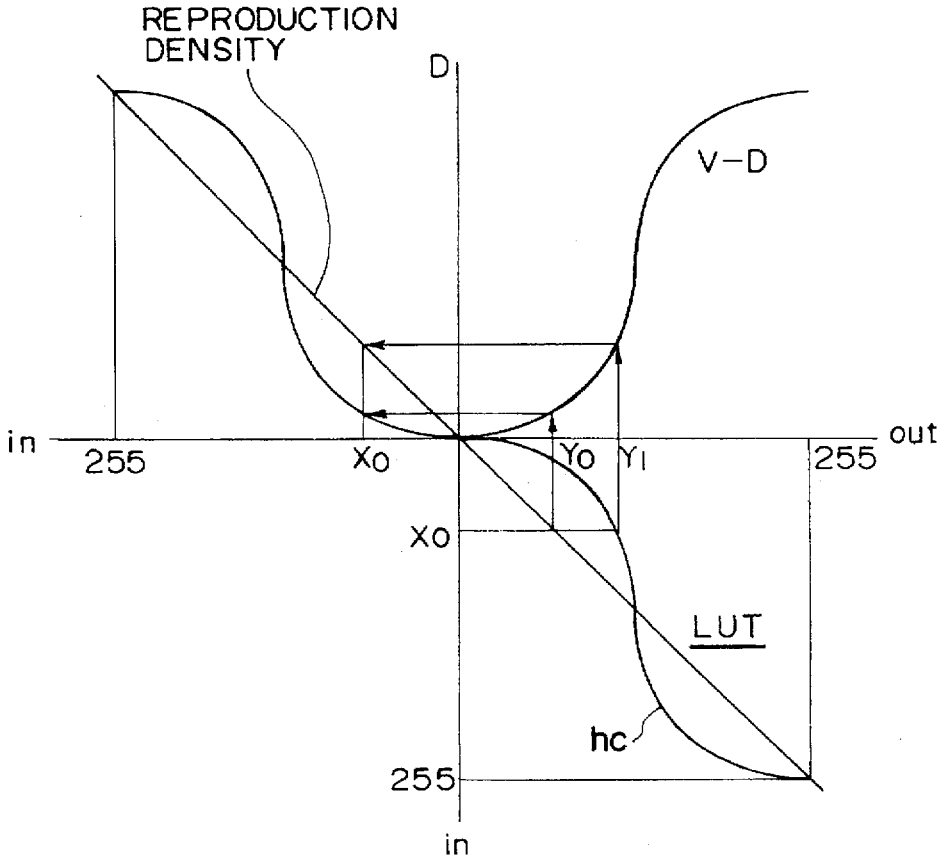

The ratios of loss of signals from the image processing circuit were actually checked by using a characteristic hc in FIGS. 8A and 8B and the characteristic hb in FIGS. 7A and 7B. Consequently, it was found that 30% or more of 256 signals were lost. The present inventors have made extensive studies and found that there are ratios at which different loss ratios cannot be distinguished from each other, depending on the density region, due to the density gradation resolving power of the human eye.

Assuming the image density is (D), the degrees to which the loss of signals in LUTs of different colors is not recognized by the human eye are 10% or less when $0.0 \leqq D \leqq 0.6$, 14% or less when $0.6 < D < 0.8$, and 20% when $0.8 \leqq D \leqq 1.6$. In addition, the degrees to which the loss of signals in an LUT of monochromatic levels is not recognized by the human eye have a larger margin than for the loss between different colors and are 15% or less when $0.0 \leqq D \leqq 0.6$, 20% or less when $0.6 < D < 0.8$, and about 30% when $0.8 \leqq D \leqq 1.6$.

The image density D herein mentioned is a reflectance density $$D = -\log_{10}\frac{R}{R_0}$$

($R_0$: reflectance of background, R: reflectance of image).

As described above, it turns out that an image forming apparatus having a plurality of image carriers must be designed by taking account of the loss of signals between colors in LUTs used to assure the density gradation in each image carrier.

An actual design of an image forming apparatus by which this condition is met will be described below.

The above explanation is made by using developers of the same color (magenta). However, an image forming apparatus with a plurality of image carriers suitable to the present invention uses four colors, yellow, magenta, cyan, and black. Therefore, it is necessary to more precisely determine the mutual relationships between these colors.

The LUT is originally used as a correcting means since the ideal development characteristic a cannot be achieved in development. Therefore, it is necessary to focus attention on the development characteristic in order to control the signal loss ratio in the LUT within a predetermined range. As described above, the development maximum density can be freely selected by setting the development contrast of each image carrier. Also, the difference between development characteristics is primarily related to the average triboelectricity of a developer in a development zone as already described. The present inventors have searched for the condition of an average triboelectricity by which no gradation discontinuity takes place in the density gradation reproduction regardless of the loss of signals in the LUT, and found the following relationship.

That is, the condition under which no gradation discontinuity occurs is when the average triboelectricity of toner in the development zone is 20 to 45 μC/g and the average triboelectricities of developers of different colors are 8 μC/g or less. This means that when the average triboelectricity of a developer of a certain color is 20 μC/g, the maximum average triboelectricity of a developer of another color is 28 μC/g or less. The maximum average triboelectricity is defined as another limitation in the present invention, e.g., a range over which multiple transfer is stably performed.

The embodiment of the present invention has been described above, but the invention is not limited to this embodiment. That is, any modification of the present invention can be made without departing from the spirit and scope of the invention.

What is claimed is:

1. An image forming apparatus comprising:

a plurality of photosensitive members;

charging means provided respectively with each of said photosensitive members for charging said photosensitive members;

exposing means for exposing said charged photosensitive members by an image light;

a plurality of developing means provided corresponding to each of said photosensitive members for developing an electrostatic image by toners of different colors;

transfer means for sequentially conveying a toner image carrying medium to a transfer position of each of said photosensitive members and transferring the toner images of different colors superimposed on the toner image carrying medium; and color mixing means for mixing the colors of the superimposed toner images, wherein a charge amount of the toner for developing the electrostatic latent image on each of said photosensitive members are substantially equal.

2. An apparatus according to claim 1, wherein the charge amount of each color toner in a development zone is 20 to 45 μC/g, and a difference of the charge amounts between the different color toners is not more than 8 μC/g.

3. An apparatus according to claim 1, wherein said exposing means exposes said photosensitive members in accordance with an image signal.

4. An apparatus according to claim 3, further comprising control means for controlling, on the basis of a density signal, an exposure amount or an exposure time for each pixel by said exposing means in accordance with a development characteristic of each developing means.

5. An apparatus according to claim 4, wherein said control means has a lookup table for correcting a density signal level in each developing means.

6. An apparatus according to claim 1, wherein yellow, magenta, cyan, and black toner images are superimposed on the toner image carrying medium.

7. An apparatus according to claim 5, wherein D represents an image density, a rate of loss of the density signal in a colored toner obtained by mixing different color toners is not more than 10% when $D \leqq 0.6$, not more than 14% when $0.6 < D < 0.8$, and not more than 20% when $0.8 \leqq D \leqq 1.6$.

* * * * *